US006064017A

United States Patent [19]

Schulze

[11] Patent Number: 6,064,017

[45] Date of Patent: May 16, 2000

[54] SWITCH HAVING A JOINT BEARING AND A METHOD OF INSERTING THE SAME

[75] Inventor: Claus-Peter Schulze, Neumünster, Germany

[73] Assignee: AEG Niederspannungstechnik GmbH & Co. KG, Neumunster, Germany

[21] Appl. No.: 09/308,590

[22] PCT Filed: Jul. 21, 1998

[86] PCT No.: PCT/EP98/04561

§ 371 Date: Jul. 27, 1999

§ 102(e) Date: Jul. 27, 1999

[87] PCT Pub. No.: WO99/16094

PCT Pub. Date: Apr. 1, 1999

[30] Foreign Application Priority Data

Sep. 23, 1997 [DE] Germany ..... 197 41 926

[51] Int. Cl.[7] ..... H01H 1/22

[52] U.S. Cl. ..... 200/244

[58] Field of Search ..... 200/271–274; 384/428, 439; 218/154, 22; 335/16, 147, 195

[56] References Cited

U.S. PATENT DOCUMENTS 4,165,453 8/1979 Hennemann ..... 200/153 G 4,944,083 7/1990 McIntosh ..... 29/622

5,137,196 8/1992 Ardueser et al. ..... 226/194

FOREIGN PATENT DOCUMENTS 33 47 641 A1 8/1984 Germany .

34 43 147 C2 5/1986 Germany .

37 25 861 C2 2/1988 Germany .

*Primary Examiner*—Michael L. Gellner

*Assistant Examiner*—Nhung Nguyen

*Attorney, Agent, or Firm*—Thomas M. Blasey; Carl B. Horton; Jay L. Chaskin

[57] ABSTRACT

A switch having a contact lever and a compression member connected so as to bias the contact lever into a contact position. The contact lever includes a joint-receiving opening disposed therein. A bearing is insertable into the joint-receiving opening of the contact lever and supports a pivot which forms a connection between the compression member and the contact lever. The joint-receiving opening includes two portions configured one behind the other in the direction of compression of the compression member. The bearing is insertable into the first opening portion in a direction different from the direction of compression and then movable in the direction of compression to produce an interlock connection with the second opening portion of the opening.

22 Claims, 5 Drawing Sheets

SWITCH HAVING A JOINT BEARING AND A METHOD OF INSERTING THE SAME

BACKGROUND OF THE INVENTION

1. Field of the Invention

The present invention relates to a switch having a contact lever into which a joint bearing can be easily inserted and movable therein.

2. Discussion of the Prior Art

Conventional switches have a contact lever prestressed by means of a compression member. The compression member is configured like a connecting rod and at one end, bears a fork embracing the contact lever. A pivot which is accommodated by a hole in the contact lever is attached to the prongs of the fork. The pivot is abutted in a bearing ring fashioned more or less centrally in the hole accommodating the joint. For this purpose, the segment of the contact lever in the region of the hole accommodating the joint is of a box-shaped configuration. The bearing ring is inserted from one side into a box-shaped accommodating segment configured in the contact lever and provided with a first hole and then fixed in the accommodating segment with a cover having a second hole such that the bearing ring is aligned with the first and the second hole. Installation of the bearing ring serving as the joint bearing thus requires a bipartite bearing housing of complicated fabrication.

BRIEF SUMMARY OF THE INVENTION

It would be desirable to provide a switch in which the joint bearing abutting the compression member in the contact lever can be installed in the contact lever in a simple and dependable manner.

According to presently preferred embodiments of the present invention, there is provided a switch having a contact lever and a compression member connected so as to bias the contact lever into a contact position. The contact lever includes a joint-receiving opening. The joint-receiving opening is configured as a key-shaped, oblong hole with two round portions of unlike diameter extending in the direction of compression of the compression member. The opening portion having the smaller diameter includes a groove in the periphery thereof. A bearing ring which is previously thrust into the opening portion having the larger diameter can be moved into the opening portion having the smaller diameter.

Other features and advantages of the present invention will become apparent from the following description of preferred embodiments of the invention which refers to the accompanying drawings.

DETAILED DESCRIPTION OF THE PREFERRED EMBODIMENTS

International PCT Application No. WO 99/16094, upon which the priority of the present invention is based, is herein incorporated by reference.

Figure 1:
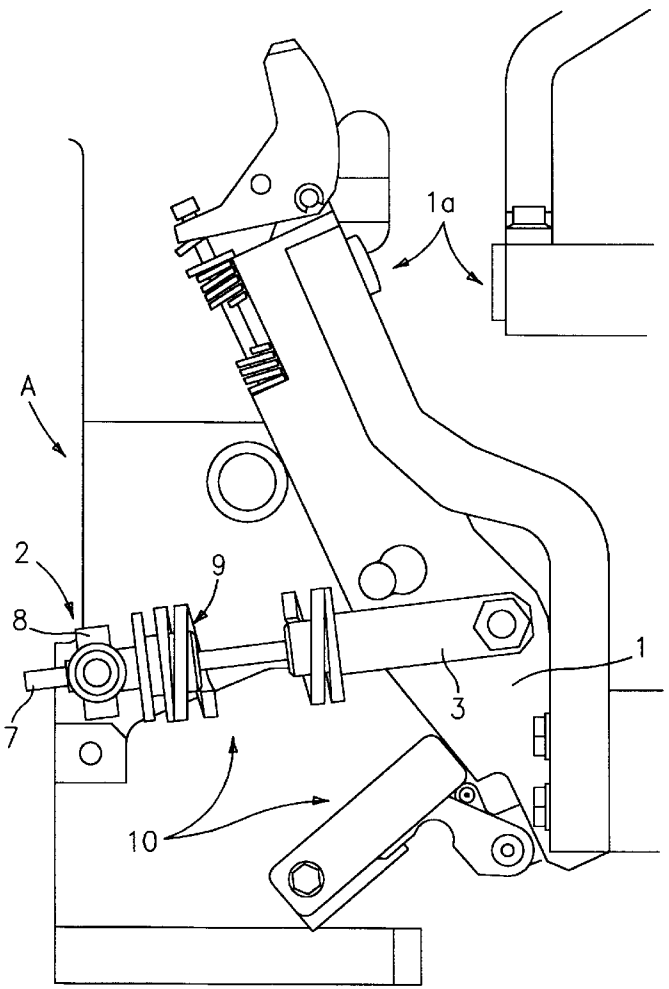
FIG. 1 is a side view of the switch, in an open condition.

As shown in FIG. 1, a switch is equipped with a contact lever 1 displaceable substantially parallel to the plane of the drawing, to bring contact elements 1*a* into contact with each other. The motion of the contact lever 1 is controlled by a linkage 10 whose principal component is a compression member 2. It should be understood that the structural details and operation of the linkage 10, do not form a part of the present invention and will not be described further herein. The compression member 2 with its several parts is shown in FIGS. 1–5.

Figure 2:
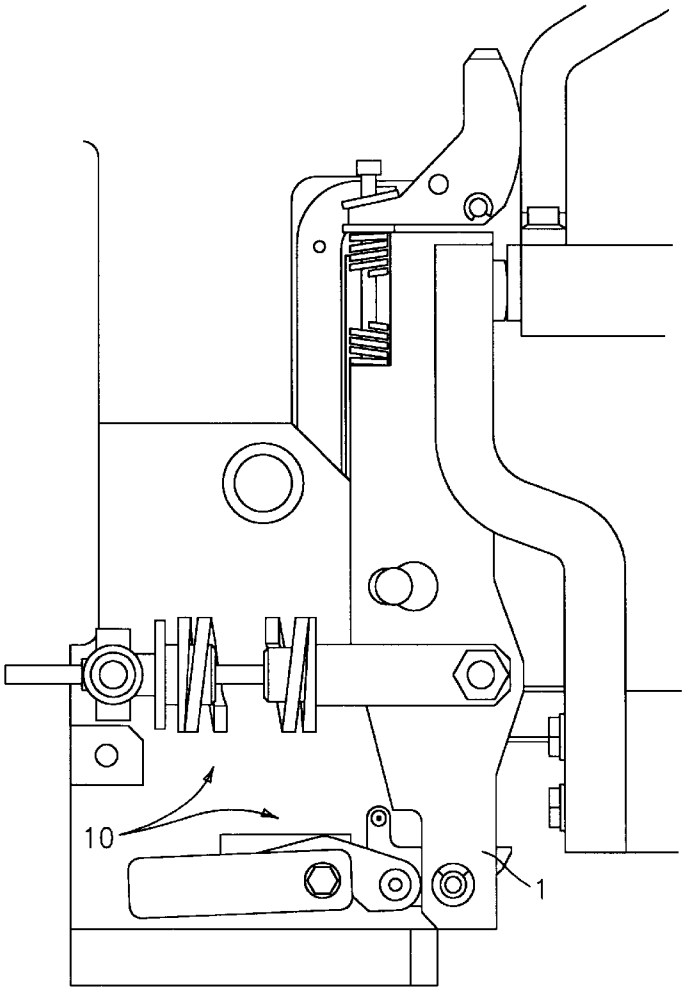
FIG. 2 is a side view of the switch in a closed condition.
Figure 3:
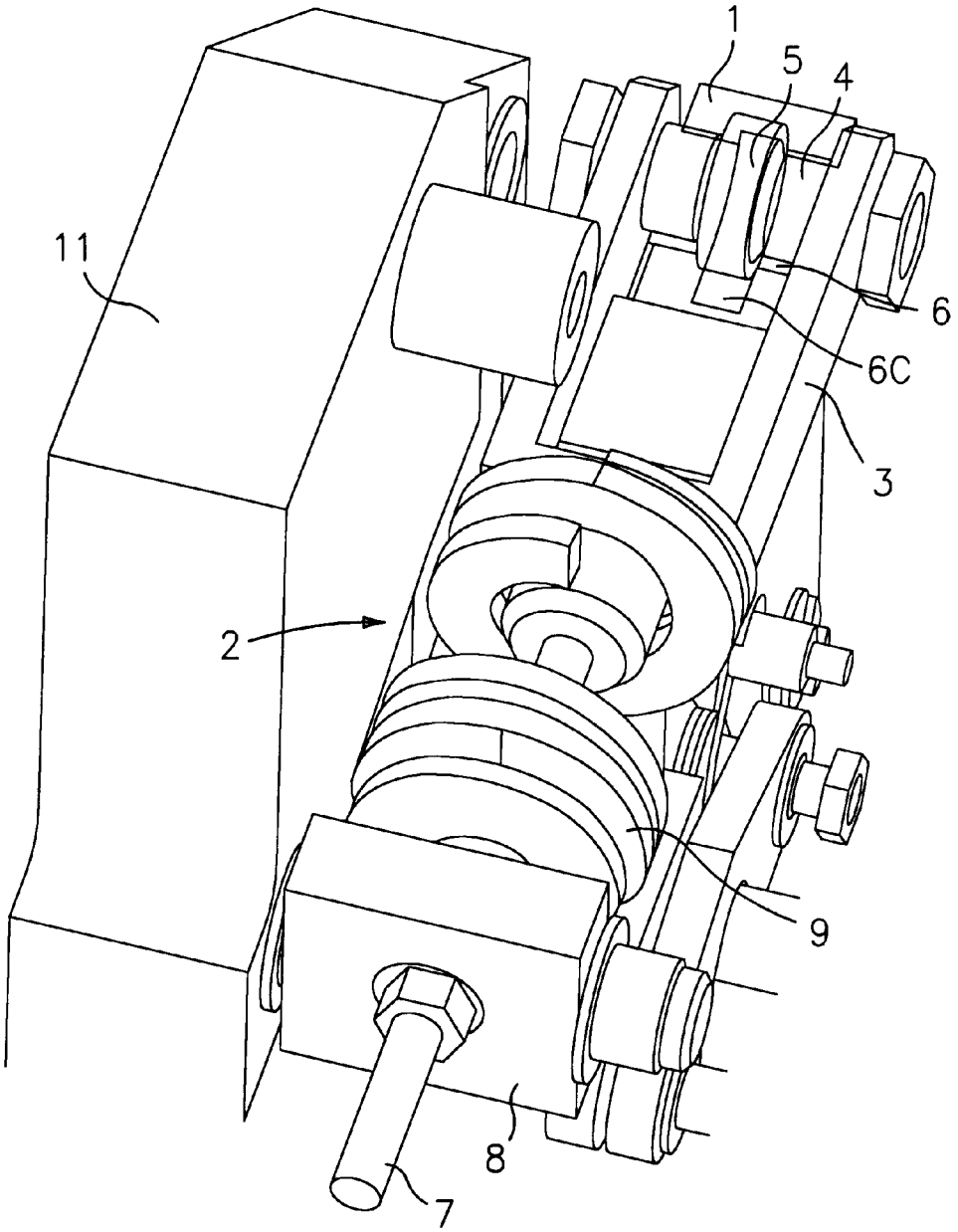
FIG. 3 is a perspective view of the switch as seen from the direction indicated by the arrow A in FIG. 1, wherein the joint-receiving opening has been exposed by removing the contact lever segment above a section line passing through the joint-receiving opening.
Figure 4:
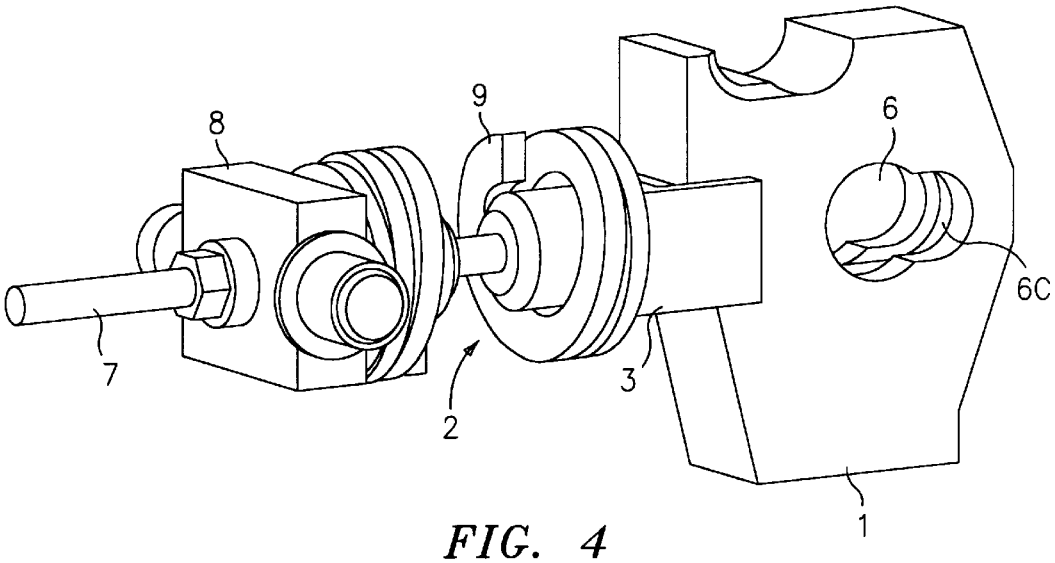
FIG. 4 is a perspective view of the compression member shown in FIG. 1, together with the corresponding segment of the contact lever in which the joint-receiving opening is located, wherein the position of the fork on the contact lever is shown.
Figure 5:
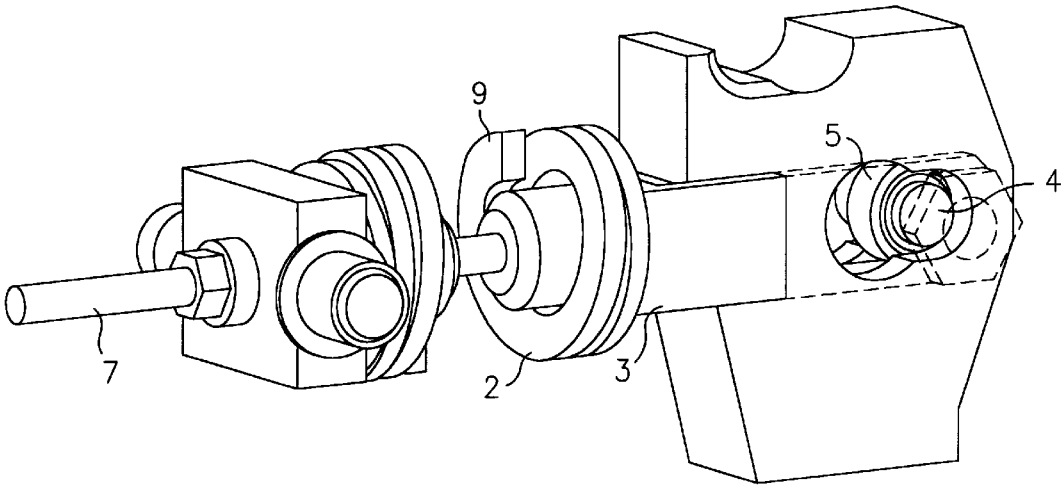
FIG. 5 is a perspective view of the compression member and contact lever where the position of the joint bearing accommodating the pivot is shown.

Referring to FIGS. 1, 2 and 3, the compression member 2 acts as a connecting rod and includes a fork 3 and a rod-like element 7 extending therefrom. Between the ends of the prongs of the fork 3, a pivot 4 (FIG. 3) is fixed by means of a screw connection. The pivot 4 in turn extends through a joint-receiving opening 6 which extends through contact lever 1. In the middle of the joint-receiving opening 6, a joint bearing 5 configured as a bearing ring, is located, communicating with pivot 4.

At the end opposite fork 3, the rod 7 is movably disposed in a hole of a tiltable support member 8. Support member 8 is rotatably mounted in two support plates 11, only one of which is shown in FIG. 1, extending parallel to the contact lever 1. Between support member 8 and fork 3, a coil spring 9 encircling rod 7 is arranged. Spring 9 pushes fork 3 of the compression member 2 toward the joint-receiving opening 6.

As shown in FIGS. 4–8, joint-receiving opening 6 is configured as an oblong, key-shaped hole having two portions of different diameter. The joint-receiving opening 6 extends essentially perpendicular to contact lever 2 and at the same time in the direction of extension of the compression member 2. The two portions 6A, 6B of the opening are configured one behind the other in the direction of prestress of the coil spring 9, such that the spring 9 urges the fork 3 and pivot 4 against portion 6B, which has a smaller diameter than portion 6A of the joint-receiving opening.

Figure 6:
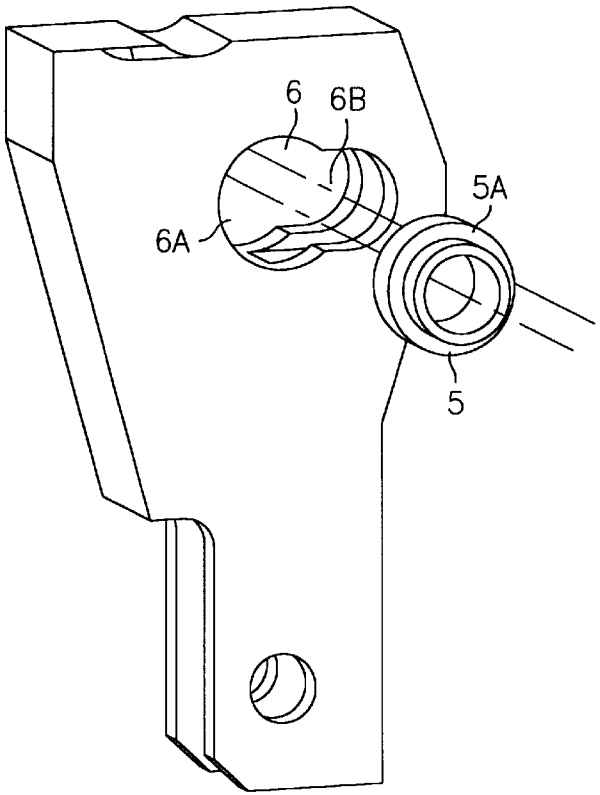
FIG. 6. is a perspective view of the installation of the joint bearing in the contact lever.
Figure 9:
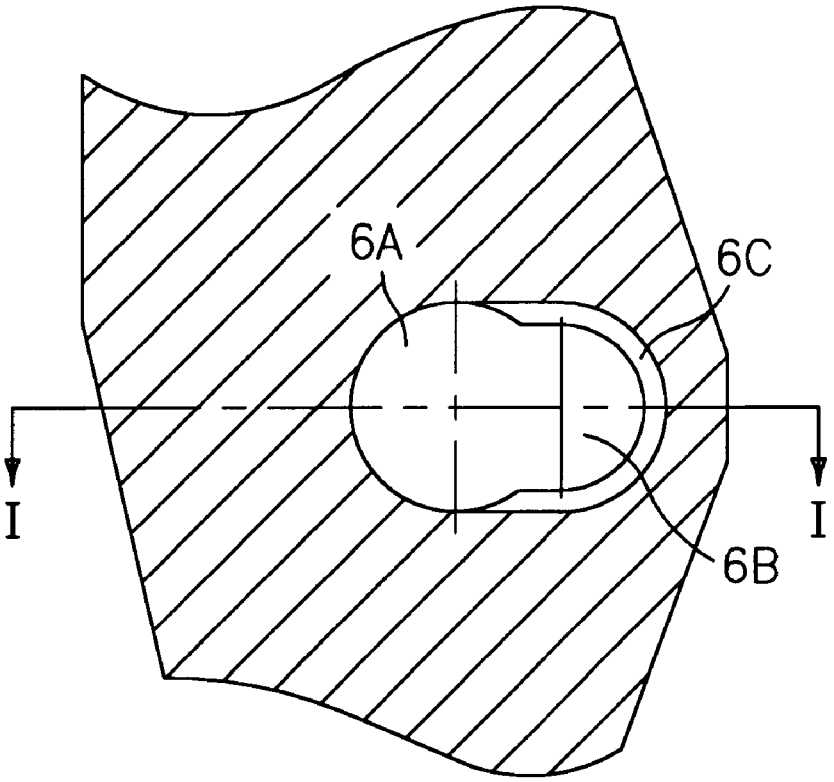
FIG. 9 is a cross-sectional view of the contact lever transverse to the centerlines of the holes of the joint-receiving opening.
Figure 10:
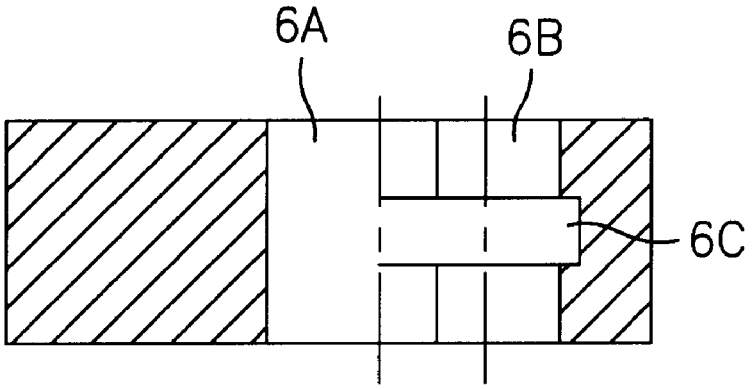
FIG. 10 is a cross-sectional view of the joint receiving opening taken along line I—I of FIG. 9.

As already set forth above and shown in detail in FIG. 6, the joint-receiving opening 6 is configured as an oblong hole and has a first opening portion 6A and a second opening portion 6B located one after the other in the direction of prestress of the spring 9, or the direction of extension of the compression member 2. Second opening portion 6B, located behind the first opening portion 6A in the direction of compression of the spring 2, has a diameter smaller than the diameter of the first segment 6A. In this second opening portion 6B, more or less centrally, is located a groove 6C, as shown in detail in FIG. 9. Groove 6C extends on the peripheral side of the second opening portion 6B at such a depth as to correspond, approximately to the diameter of the first opening portion 6A of the joint-receiving opening 6.

Figure 8:
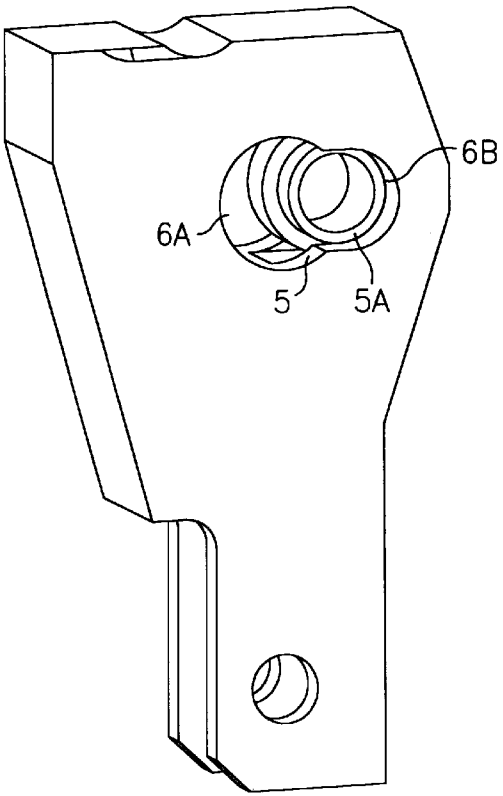
FIG. 8 is a perspective view wherein the joint bearing is located within the second opening portion of the joint-receiving opening.
Figure 7:
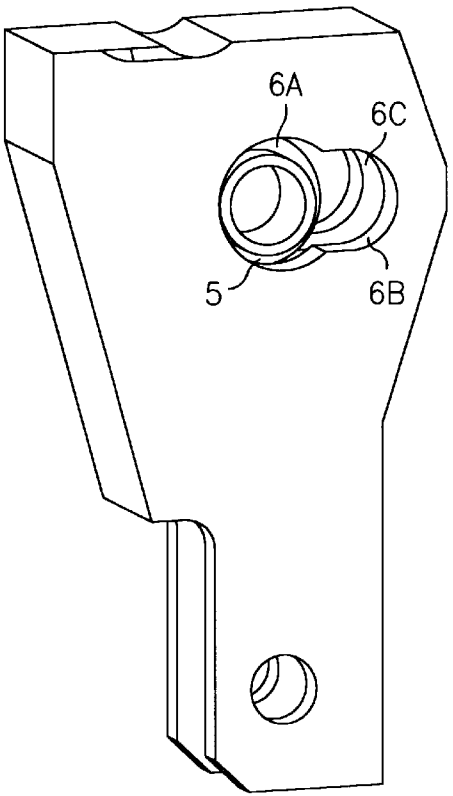
FIG. 7 is a perspective view wherein the joint bearing is located within the first opening portion of the joint-receiving opening.

The joint bearing 5 serving to support the pivot 4 is configured as a bearing ring on the outer peripheral surface of which is formed an annular projection 5A. Projection 5A is so dimensioned that it can serve as a tongue member for a tongue-and-groove connection to be made with the groove 6C. For this purpose, the width of the projection 5A, to be measured in the axial direction of the bearing ring, is only slightly smaller than the width of the groove 6C formed in the second opening portion 6B of the joint-receiving opening 6. As shown in FIGS. 6–8, bearing ring 5 is first thrust laterally into the first opening portion 6A of the joint-receiving opening 6 until the projection 5A arrives axially in such a location that the projection 5A is aligned with the groove 6C. Next, the bearing ring 5 is moved from the position shown in FIG. 7 towards the second opening portion 6B of the joint-receiving opening 6 until the projection 5A extends into the groove 6C and thus becomes fixed in second opening portion 6B.

Because the compression member 2, which is supported on the bearing ring 5 by means of the fork 3 and the pivot 4, is prestressed against the contact lever 1 in the direction of compression of the spring 9, there is no danger that bearing ring 5 will move from the first opening portion 6A of the joint-receiving opening. Since spring 9 is essentially under prestress in service, the need for fixation of the bearing ring 5 in a negative force direction of the spring is eliminated.

Groove 6C may be alternatively configured, for example, as a T-shaped groove. The depth of the groove should be sufficient to ensure a stable fixation of the projection 5A of the bearing ring 5 within groove 6C of opening 6. Joint-receiving opening 6, shown shaped as an oblong hole, may have a variety of different shapes. Likewise, groove 6C itself need not be necessarily configured as a "through-depression" in the bore periphery of the second opening portion 6B.

According to one embodiment of the present invention, the support bearing 5 is inserted in the first opening portion of the contact lever in a first direction, and then, by the clamping action of the compression member, fitted into the second opening portion in a second direction, such that it remains fixed in the second opening portion.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. A switch comprising:

a contact lever;

a joint-receiving opening disposed in the contact lever, the opening having a first and second opening portion; and a joint bearing inserted into the first opening portion of the joint-receiving opening, wherein the joint bearing is movable into the second opening portion to establish a locking connection with the contact lever.

2. The switch of claim 1, wherein the first opening portion has a diameter which is larger than a diameter of the second opening portion.

3. The switch of claim 2, wherein the second opening portion is disposed adjacent the first opening portion.

4. The switch of claim 3, wherein the second opening portion includes a groove along the diameter thereof, the groove having a diameter which is the same as the diameter of the first opening portion, such that the diameter of the first opening portion and the diameter of the groove merge together.

5. The switch of claim 4, wherein the joint bearing includes a projection extending from an outer peripheral surface thereof, such that when the joint bearing is moved into the second opening portion the projection of the joint bearing extends into the groove.

6. The switch of claim 5, further comprising a compression member connected so as to bias the contact lever into a contact position.

7. The switch of claim 6, wherein the compression member has a pair of opposed ends and further comprising a fork attached to one end of the compression member.

8. The switch of claim 7, further comprising a pivot which extends through the fork and the contact lever, such that the compression member is pivotable about the contact lever.

9. A switch comprising:

a contact lever;

a compression member connected so as to bias the contact lever into a contact position;

a joint-receiving opening disposed in the contact lever, the opening having a first and second opening portion, the second opening portion being located behind the first opening portion in a tensioning direction of the compression member, and a joint bearing inserted into the first opening portion of the joint-receiving opening, wherein the joint bearing is movable into the second opening portion to establish a locking connection with the contact lever.

10. The switch of claim 9, wherein the second opening portion has a diameter which is smaller than a diameter of the first opening portion.

11. The switch of claim 10, wherein the second opening portion includes a groove along the diameter thereof, the groove having a diameter which is the same as the diameter of the first opening portion, such that the diameter of the first opening portion and the diameter of the groove merge together.

12. The switch of claim 11, wherein the joint bearing includes a projection extending from an outer peripheral surface thereof, such that when said joint bearing is moved into the second opening portion the projection of the joint bearing extends into the groove.

13. The switch of claim 9, wherein the compression member has a pair of opposed ends and further comprising a fork attached to one end of the compression member.

14. The switch of claim 13, further comprising a pivot which extends through the fork and the contact lever, such that the compression member is pivotable about the contact lever.

15. A method of installing a joint bearing in a contact lever of a switch, comprising the steps of:

providing a contact lever;

locating a joint receiving opening in the contact lever, the joint receiving opening having a first and second opening portion;

inserting a joint bearing into the first opening portion of the joint receiving opening; and moving the joint bearing into the second opening portion to establish a locking connection with the contact lever.

16. The method of claim 15, wherein the first and second opening portions are adjacent and the step of moving the joint bearing into the second opening portion comprises sliding the joint bearing from the first opening portion into the second opening portion.

17. The method of claim 15, wherein the first opening portion has a diameter larger than a diameter of the second opening portion and the step of moving the joint bearing into the second opening portion comprises sliding the joint bearing from the larger diameter of the first opening portion into the smaller diameter of the second opening portion.

18. The method of claim 15, further comprising the step of providing the second opening portion with a groove along a diameter thereof.

19. The method of claim 18, further comprising the step of providing a projection on the joint bearing.

20. The method of claim 19, wherein the step of moving the joint bearing into the second opening portion comprises sliding the joint bearing from the first opening portion into the second opening portion such that the projection of the joint bearing is slid into the groove of second opening portion.

21. The method of claim 15, further comprising the step of connecting the contact lever to a compression member so as to bias the contact lever in a contact position.

22. The switch of claim 21, further comprising the step of tensioning the compression member to move the joint bearing from the first opening portion to the second opening portion of the contact lever.

* * * * *